US008337218B2

(12) United States Patent
Hirata et al.

(10) Patent No.: US 8,337,218 B2
(45) Date of Patent: Dec. 25, 2012

(54) HIGH DENSITY SURFACE MOUNT CONNECTOR

(75) Inventors: Toshihisa Hirata, Kanagawa (JP); Masami Sasao, Machida (JP)

(73) Assignee: Molex Incorporated, Lisle, IL (US)

( * ) Notice: Subject to any disclaimer, the term of this patent is extended or adjusted under 35 U.S.C. 154(b) by 181 days.

(21) Appl. No.: 12/530,338

(22) PCT Filed: Mar. 10, 2008

(86) PCT No.: PCT/US2008/003135

§ 371 (c)(1),
(2), (4) Date: Jan. 11, 2011

(87) PCT Pub. No.: WO2008/109169

PCT Pub. Date: Sep. 12, 2008

(65) Prior Publication Data

US 2011/0097936 A1 Apr. 28, 2011

(30) Foreign Application Priority Data

Mar. 8, 2007 (JP) ..... 2007-058688

(51) Int. Cl.
*H01R 12/00* (2006.01)

(52) U.S. Cl. ..... 439/83; 439/660

(58) Field of Classification Search ..... 439/74, 439/83, 660, 329

See application file for complete search history.

(56) References Cited

U.S. PATENT DOCUMENTS

| | | | | |
|---|---|---|---|---|
| 5,921,787 | A | 7/1999 | Pope et al. | |
| 7,736,154 | B2 * | 6/2010 | Hirata et al. | 439/74 |
| 2004/0053521 | A1 * | 3/2004 | Kashio | 439/74 |

FOREIGN PATENT DOCUMENTS

| | | |
|---|---|---|
| JP | H09-143853 | 12/1998 |
| WO | WO 2006/102452 A1 | 9/2006 |

OTHER PUBLICATIONS

International Search Report for PCT/US2008/003135.

* cited by examiner

*Primary Examiner* — Khiem Nguyen
(74) *Attorney, Agent, or Firm* — Timothy M. Morella

(57) ABSTRACT

A surface mount connector includes first terminals and second terminals to be mated to counterpart terminals of a mating counterpart connector. The first terminals and the second terminals are mounted in a housing in an alternating array. Each of the first terminals includes a contact portion to be connected to a first counterpart terminal, a fixing portion connected to an outer side of the contact portion and fixed to the housing, and a surface-mounting soldering portion connected to an outer side of the fixing portion. Each of the second terminals includes a contact portion to be connected to a second counterpart terminal, a fixing portion connected to an outer side of the connecting portion and fixed to the housing, and a surface-mounting soldering portion connected to a mounting-surface side end of the fixing portion.

12 Claims, 7 Drawing Sheets

HIGH DENSITY SURFACE MOUNT CONNECTOR

BACKGROUND OF THE INVENTION

The present invention relates to a surface mount connector.

Conventionally, a connector such as a card edge connector is used to electrically connect a substrate such as a circuit board to another substrate. (For example, refer to Japanese Patent Application Laid-Open (Kokai) No. H10-335025.) In a connector of such kind, locations of tail portions through which terminals are connected to the substrate are alternately shifted in the transverse direction with respect to the array direction of the terminals in a zigzag form.

FIGS. 7A and 7B are cross sectional views of a conventional connector. Note that FIG. 7A is a cross sectional view showing a first terminal, and FIG. 7B is a cross sectional view showing a second terminal.

As shown in FIGS. 7A and 7B, the connector includes a housing 301 which is formed from an insulating material such as synthetic resin, and first terminals 311A and second terminals 311B which are formed from a conductive material such as metal and mounted on the housing 301. The first terminals 311A and the second terminals 311B are mounted on the housing 301 so that the terminals are alternately located with respect to the array direction of the terminals (the direction perpendicular to the drawings). Also, the housing 301 is attached to a substrate 302 such as a mother board by not-illustrated fixing means such as bolts.

Further, the housing 301 has a first cavity 303 into which, a fixing contact portion 312 and a spring contact portion 313 of each of the first terminals 311A and the second terminals 311B are accommodated. Moreover, a press-fit portion 315 is connected to the fixing contact portion 312 of each of the first terminals 311A and the second terminals 311B via a bent back portion 314, and the press-fit portion 315 is press-fitted into a second cavity 304 of the housing 301, and fixed thereto. Further, a lower end portion 317 is connected to the press-fit portion 315 via a curved portion 316, and the lower end portion 317 is inserted into a through hole 306 of the substrate 302 and soldered. Because of this, the first terminals 311A and the second terminals 311B are electrically connected to not-illustrated conductive traces which are connected to the corresponding through holes 306. Since the lower end portion 317 is soldered from the back side (the right side in the drawings) of the substrate 302, a solder fillet 321 is formed. Also, since melted solder flows through a gap in the through hole 306 due to a capillary phenomena, a solder fillet 322 is formed on the surface of the substrate 302 as well.

As seen from the comparison between FIGS. 7A and 7B, locations of the lower end portions 317 of each of the first terminals 311A and the lower end portion 317 of each of the second terminals 311B are shifted from each other in the transverse direction (the vertical direction in the drawings) with respect to the array direction of the terminals. Note that the through holes 306 are also provided to correspond to the lower end portions 317. Therefore, the locations where the lower end portions 317 are connected to the base bard 302 are in the zigzag form. Further, a cut-out 305 is formed in the end portion of the housing 301 on the substrate 302 side. Hence, it can be checked whether or not the lower end portions 317 and the through holes 306 are soldered appropriately, by viewing the solder fillets 321 from the back side of the substrate 302, and by viewing the solder fillets 322 from the front side of the substrate 302.

Nevertheless, in the conventional connector described above, since the lower end portions 317 are inserted into the through holes 306 of the substrate 302 and soldered thereto, the connector has not been able to be used for high-density mounting. Generally, in the high-density mounting where electronic parts and connectors are mounted on a substrate at high density, electronic parts and connectors are mounted on both sides of a substrate. However, in the conventional connector, since the lower end portions 317 project on the back side of the substrate 302, no other connectors and electronic parts can be mounted on the back side of the connector. Moreover, since a substrate used for high-density mounting generally has a shield plate inserted inside, and if through holes are formed, the shield will not function. However, in the conventional connector, since the lower end portions 317 need to be inserted into the through holes 306, the connector cannot be mounted on a substrate in which a shield plate is inserted. The conventional connector is originally a card edge connector for connecting a substrate to another substrate, and therefore is not envisaged to be used for high-density mounting in which micro-sized electronic parts and connectors are mounted on a substrate at a high density.

SUMMARY OF THE INVENTION

It is an object of the invention to solve the problems of the conventional connector, and to provide a surface mount connector which comprises first terminals each including a connecting portion to be connected to a counterpart terminal of a counterpart connector, a fixing portion connected to an outer side of the connecting portion, and a surface-mounting soldering portion connected to an outer side of the fixing portion, and second terminals each including the connecting portion, the fixing portion, and a surface-mounting soldering portion connected to a distal end of the fixing portion, and a housing on which the first and second terminals are mounted, and a cut-out portion including a tapered surface is formed in a mounting-surface side end of an outer portion of the housing, whereby the soldering portions can be located in a zigzag or staggering form, the soldering states of the soldering portions of the second terminals can be visibly inspected, mount of the connector on a substrate is ensured, a connection defect does not occur, manufacturing costs become low, and reliability becomes high.

Therefore, a surface mount connector according to the present invention includes first terminals and second terminals to be connected to counterpart terminals of a counterpart connector, and a housing on which the first terminals and the second terminals are arrayed alternately and mounted, wherein each of the first terminals is provided with a connecting portion to be connected to the counterpart terminal, a fixing portion connected to an outer side of the connecting portion and fixed to the housing, and a surface-mounting soldering portion connected to an outer side of the fixing portion, each of the second terminals is provided with a connecting portion to be connected to the counterpart terminal, a fixing portion connected to an outer side of the connecting portion and fixed to the housing, and a surface-mounting soldering portion connected to a mounting-surface side end of the fixing portion, and the housing is provided with a cut-out portion including a tapered surface formed in a mounting-surface side end of an outer portion thereof.

In another embodiment of the surface mount connector, each of the connecting portions is provided with a front side wall portion and a back side wall portion extending in a fitting direction to the counterpart connector, and a bottom portion extending in a direction perpendicular to the fitting direction and connecting the front side wall portion and the back side wall portion, and the housing is provided with a bottom plate portion extending in a direction perpendicular to the fitting direction on the mounting-surface side of the bottom portion.

In a still further embodiment of the surface mount connector, the housing is provided with a side wall portion in which terminal fixing holes are provided into which the fixing portions are press-fitted, and the fixing portions are press-fitted into the terminal fixing holes by being moved to the side wall portion from a side on which the counterpart connector is fitted towards the mounting surface.

In a yet further embodiment of the surface mount connector, the soldering portion of each of the first terminals extends along a side surface of an outer portion of the side wall portion, and the soldering portion of each of the second terminals extends from the terminal fixing hole toward the mounting surface.

In a still further embodiment of the surface mount connector, the tapered surface is formed in the mounting-surface side end of a portion of the side wall portion which is located on an outer side of the terminal fixing hole.

In a still further embodiment of the surface mount connector, the soldering portion of each of the second terminals extends to the mounting-surface side of a surface extending from the tapered surface toward the mounting surface.

According to the present invention, the surface mount connector comprises first terminals each including a connecting portion to be connected to a counterpart terminal of a counterpart connector, a fixing portion connected to an outer side of the connecting portion, and a surface-mounting soldering portion connected to an outer side of the fixing portion, and second terminals each including the connecting portion, the fixing portion, and a surface-mounting soldering portion connected to a distal end of the fixing portion, and a housing on which the first and second terminals are mounted, and a cut-out portion including a tapered surface is formed in a mounting-surface side end of an outer portion of the housing. Therefore, the soldering portions can be located in a zigzag or staggering form, the soldering states of the soldering portions of the second terminals can be visibly inspected, mount of the connector on a substrate is ensured, a connection defect does not occur, manufacturing costs become low, and reliability becomes high.

BRIEF DESCRIPTION OF THE DRAWINGS

FIGS. 7A and 7B are cross sectional views of a conventional connector, in which FIG. 7A is a cross sectional view showing a first terminal, and FIG. 7B is a cross sectional view showing a second terminal.

DESCRIPTION OF THE PREFERRED EMBODIMENTS

Preferred embodiments of the present invention will be described below in detail with reference to the accompanying drawings.

Figure 1:
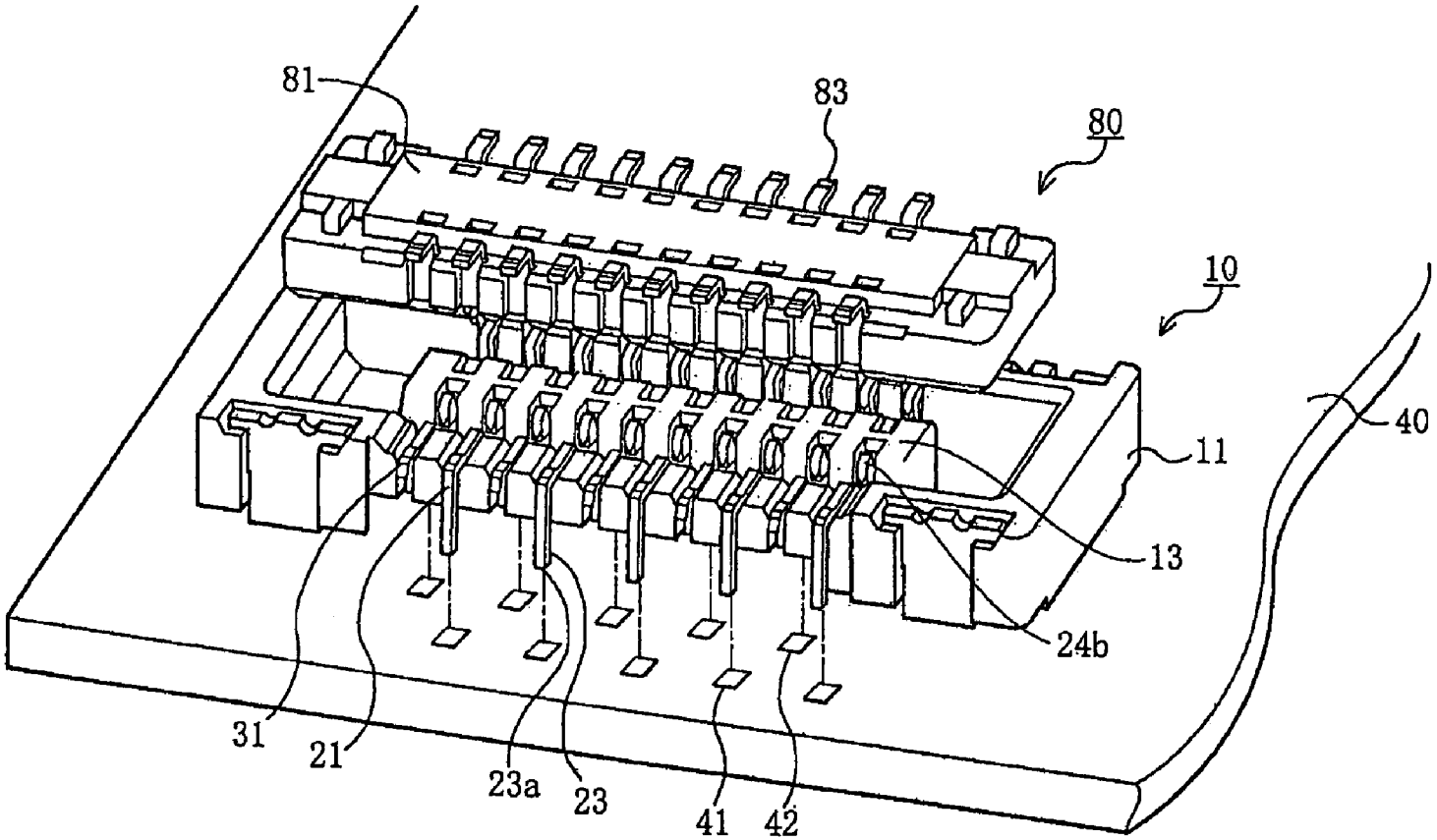
FIG. 1 is a perspective view showing a state where a surface mount connector according to a first embodiment of the present invention is mounted on a substrate and a counterpart connector is positioned in close proximity to such surface mount connector.
Figure 2:
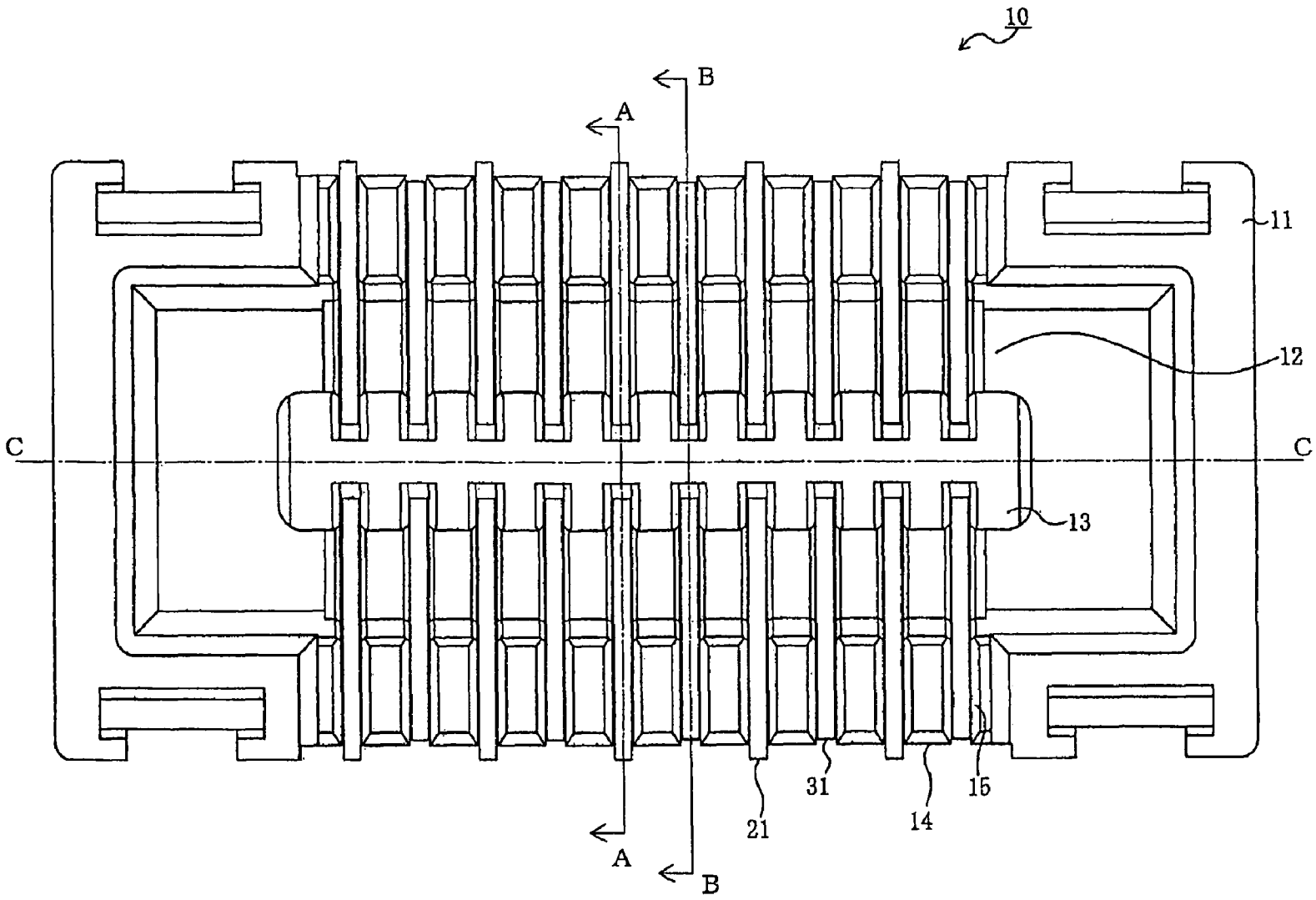
FIG. 2 is a top view of the surface mount connector according to the first embodiment the present invention.
Figure 3:
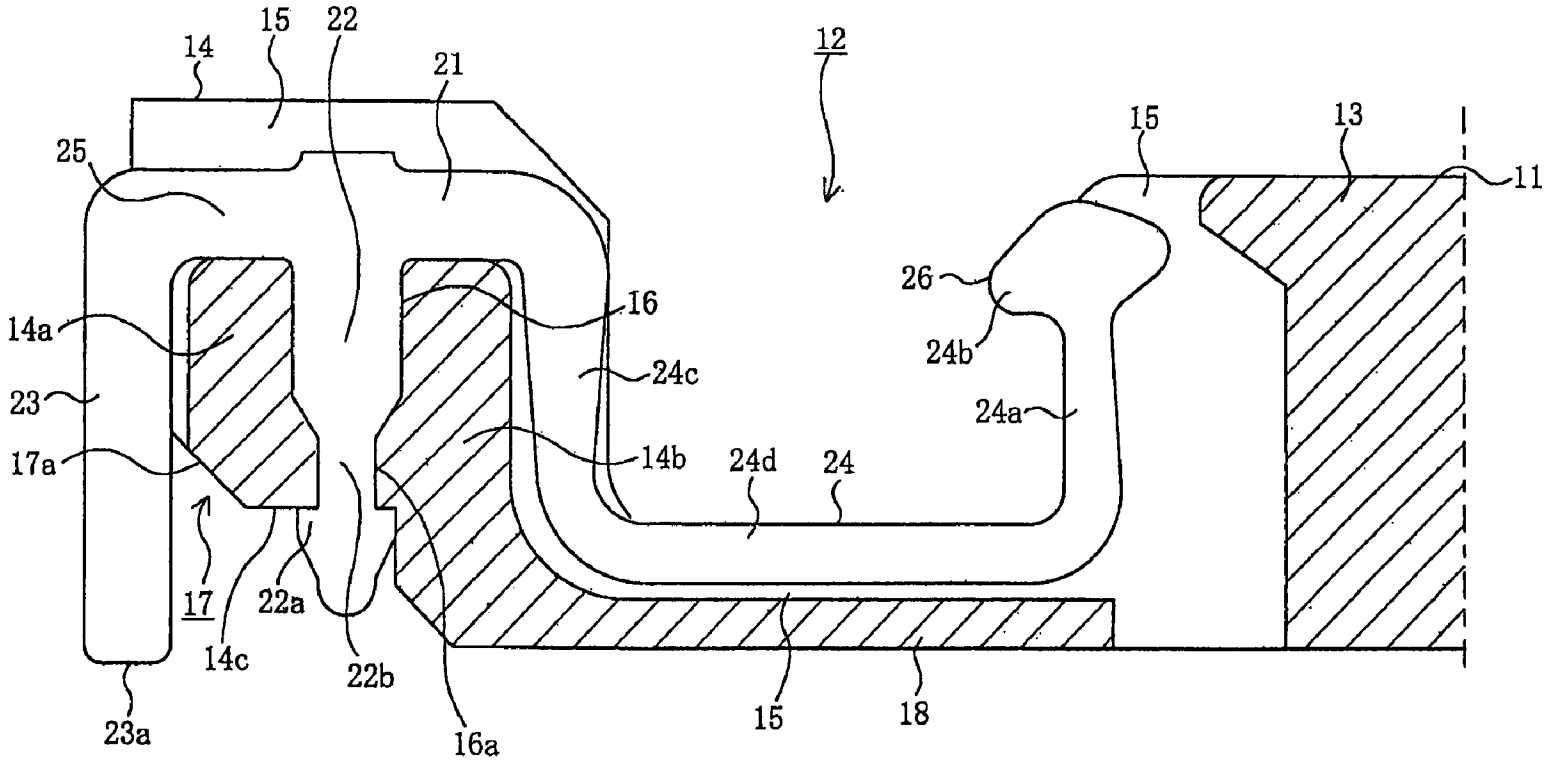
FIG. 3 is a fragmented cross sectional view of the surface mount connector according to the first embodiment of the present invention, taken along the arrow A-A of FIG. 2.
Figure 4:
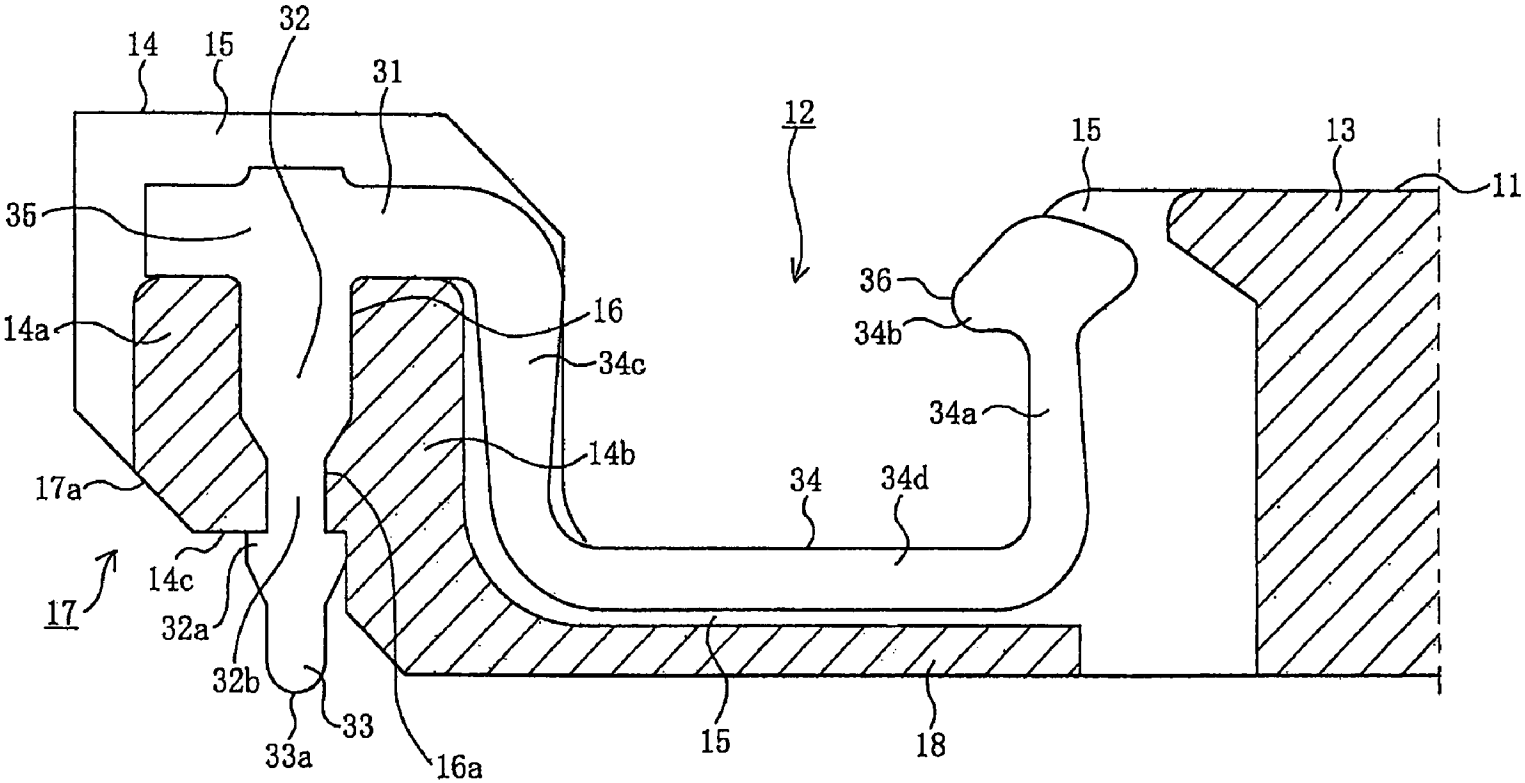
FIG. 4 is a fragmented cross sectional view of the surface mount connector according to the first embodiment of the present invention, taken along the arrow B-B of FIG. 2.

FIG. 1 is a perspective view showing a state where a surface mount connector according to a first embodiment of the present invention is mounted on a substrate and a counterpart connector is positioned in close proximity thereto and aligned for mating therewith, FIG. 2 is a top view of the surface mount connector according to the first embodiment the present invention, FIG. 3 is a fragmented cross sectional view of the surface mount connector according to the first embodiment of the present invention, taken along the arrow A-A of FIG. 2, and FIG. 4 is a fragmented cross sectional view of the surface mount connector according to the first embodiment of the present invention, taken along the arrow B-B of FIG. 2.

In the drawings, reference numeral 10 represents a surface mount connector according to an embodiment, and reference numeral 80 represents a counterpart connector to be mated to the surface mount connector 10. The surface mount connector 10 is a surface mount-type connector to be mounted on a surface of a substrate or circuit member 40 such as a printed circuit board (PCB) or flex circuit. The counterpart connector 80 is surface-mounted on a bottom surface of an upper printed circuit board (not shown) facing the substrate 40. Solder tail portions 83 of the terminals of the counterpart connector 80 are soldered to a pattern formed on the bottom surface of the upper printed circuit board, and a housing 81 of the counterpart connector 80 is appropriately fixed to the upper printed circuit board as is known in the art. In this case, the lower surface in the FIGS. 3 and 4 is a mounting-surface of the surface mount connector 10, which faces the mounting-surface of the substrate 40. Note that, since the above-mentioned surface mount connector 10 is line-symmetrical with respect to the center line C-C shown in FIG. 2, and only a half of the connector on one side from the center line C-C is shown in FIGS. 3 and 4, and thus illustration of cross sections of the other half of the connector on the other side are omitted. Furthermore, during mating, the counterpart connector 80 is moved from the top to the bottom as viewed in FIGS. 3 and 4 in order to mate with surface mount connector 10. Note that the counterpart connector 80 illustrated in FIG. 1 is a surface mount connector which is surface-mounted on a counterpart substrate, but may be any type of connector.

In this embodiment, representations of directions such as up, down, left, right, front, rear, and the like, used for explaining the structure and movement of each part of the surface mount connector 10, and the like, are not absolute, but relative. These representations are appropriate when each part of the surface mount connector 10, and the like, is in the position shown in the figures. If the position of the surface mount connector 10, and the like, changes, however, it is assumed that these representations are to be changed according to the change of the position of the surface mount connector 10, and the like.

The surface mount connector 10 includes a housing 11 as a connector body which is integrally formed from an insulating material such as synthetic resin. As shown in FIGS. 1 and 2, the housing 11 has an approximately rectangular thick plate shape, and includes, on the top surface thereof, an approximately rectangular recessed portion formed by surrounding side walls. In the recessed portion, a linearly extending projection 13 is formed integrally with the housing 11, and side wall portions 14 which extend in parallel with the linearly extending projection 13 are formed integrally with the housing 11 on both sides of the linearly extending projection 13. In this case, the linearly extending projection 13 and the side wall portions 14 project upward from the surface of the recessed portion, and extend in the longitudinal direction of the housing 11. Therefore, long and thin recessed groove portions 12 which extend in the longitudinal direction of the housing 11 are formed on both sides of the linearly extending projection 13 and between the linearly extending projection 13 and each side wall portion 14.

In the embodiment, the housing 11 has groove-shaped terminal accommodating or receiving cavities 15 formed therein, which extend over the both side surfaces of the linearly extending projection 13, the bottom surfaces of the recessed groove portions 12, the inner side surfaces of the side wall portions 14, the top surfaces of the side wall portions 14, and the outer side surfaces of the side wall portions 14. First terminals 21 and second terminals 31 are accommodated in the terminal accommodating cavities 15 and mounted on the housing 11. Note that, for example, ten terminal accommodating cavities 15 are formed at a pitch of approximately 0.3 mm on each side surface of the linearly extending projection 13 and on the bottom surface of the recessed groove portion 12. As the first terminals 21 and the second terminals 31 to be accommodated in the terminal accommodating cavities 15, respectively, are accommodated in the terminal accommodating cavities 15, the terminals are also mounted on the housing 11 at the same pitch as the terminal accommodating cavities 15. The number and the pitch of the terminal accommodating cavities 15 can be changed as necessary for the particular application.

Note that, as shown in FIGS. 1 and 2, the first terminals 21 and the second terminals 31 are accommodated alternately in the terminal accommodating cavities 15. In the example shown in the drawings, the first terminals 21 are accommodated in the odd-numbered terminal accommodating cavities 15 from the left, and the second terminals 31 are accommodated in the even-numbered terminal accommodating cavities 15 from the left. Further, as shown in FIGS. 3 and 4, in a portion in each of the terminal accommodating cavities 15 which corresponds to the top surface of the side wall portion 14, a terminal fixing hole 16 piercing through the side wall portion 14 in the vertical direction is formed.

As shown in FIG. 3, each of the first terminals 21 is a conductive member which is provided with a press-fit portion 22 as a fixing portion, a solder tail portion 23 as a surface-mounting soldering portion, and a connecting or contact portion 24 to be connected to or mate with the counterpart terminal of the counterpart connector 80. First terminals 21 are preferably formed as a one-piece member by stamping a conductive metal plate. Here, the connecting portion 24 is formed in an approximately U-letter shape with a front side wall portion 24*a*, a back side wall portion 24*c*, and a bottom portion 24*d* which are described later, the other portions (the portions on the outer side from the connecting portion 24) are formed into an approximately F-letter shape by the press-fit portion 22, the solder tail portion 23, and a later-described horizontal portion 25, and the first terminal 21, as a whole, has a side shape which looks as if the U-letter and the F-letter are connected together.

The connecting portion 24 includes the front side wall portion 24*a* as a side wall portion closer to a distal end 26, and the back side wall portion 24*c* as a side wall portion closer to the solder tail portion 23, both extending in the fitting direction to the counterpart connector 80, in other words, in the perpendicular direction to the mounting-surface (the vertical direction in FIG. 3). The front side wall portion 24*a* is a portion of the connecting portion 24, located on the inner side of the housing 11, and is accommodated in the terminal accommodating cavity 15 formed in the side surface of the linearly extending projection 13. The back side wall portion 24*c* is a portion of the connecting portion 24, located on the outer side of the housing 11, and is accommodated in the terminal accommodating cavity 15 formed in the inner side surface of the side wall portion 14.

Further, the bottom portion 24*d* of the connecting portion 24, which is a portion connecting the front side wall portion 24*a* and the back side wall portion 24*c*, in other words, a portion which corresponds to the bottom of the U letter, extends in the perpendicular direction to the fitting direction to the counterpart connector 80, in other words, a direction in parallel with the mounting-surface (the transverse direction in FIG. 3), and is mounted in the terminal accommodating cavity 15 formed in the bottom surface of the recessed groove portion 12. Note that, a bottom plate portion 18 of the housing 11 is provided underneath the bottom portion 24*d* of the connecting portion 24. As described above, since the bottom plate portion 18 is positioned between the connecting portion 24 and the mounting-surface of the substrate 40, the connecting portion 24 does not come into contact with the mounting-surface of the substrate 40. Therefore, conductive traces can be provided on the mounting-surface of the substrate 40 beneath the surface mount connector 10, allowing a higher density conductive trace array on the substrate 40.

Furthermore, in the vicinity of a free end (the top end in FIG. 3) of the front side wall portion 24*a*, a contact portion 24*b* to come into contact with the counterpart terminal of the counterpart connector 80 is formed. The contact portion 24*b* is formed so as to project from a surface of the housing 11 closer to the outer side in the region of the front side wall portion 24*a*, in other words, a surface of the recessed groove portion 12 facing the inside thereof, and is located within the recessed groove portion 12 so that at least the distal end 26 thereof projects to the outside of the terminal accommodating cavity 15 formed in the side surface of the linearly extending projection 13. Note that most of the back side wall portion 24*c* is located within the terminal accommodating cavity 15 formed in the inner side surface of the side wall portion 14.

The connecting portion 24 has a spring property generated by elastic deformation. Therefore, when the counterpart connector 80 is mated to the surface mount connector 10, and the contact portion 24*b* moves towards the linearly extending projection 13 by engaging the counterpart terminal, the contact portion 24*b* deflects due to the spring property, and is mated with the counterpart terminal, which ensures that electrical connection between the first terminal 21 and the counterpart terminal is maintained.

Further, the horizontal portion 25 of the first terminal 21, in other words, a portion connecting the top end of the back side wall portion 24*c* of the connecting portion 24, the top end of the press-fit portion 22, and the top end of the solder tail portion 23, extends in a direction parallel with the mounting-surface, and is accommodated within the terminal accommodating cavity 15 formed in the top surface of the side wall portion 14. The top end of the back side wall portion 24*c* of the connecting portion 24 is connected to the end of the horizontal portion 25 on the inner side, in other words, the end thereof closer to the inner side of the housing 11, and, the top end of the solder tail portion 23 is connected to the end of the horizontal portion 25 on the outer side, in other words, the end thereof closer to the outer side of the housing 11.

The solder tail portion 23 extends in the fitting direction to the counterpart connector 80, and a bottom end portion thereof, in other words, an end portion thereof on the substrate side, functions as a soldering portion 23*a* to be connected by soldering to a connecting pad 41 formed on the mounting surface of the substrate 40. The position of the soldering portion 23*a* is the same as the bottom surface of the housing 11 or projected from the bottom surface of the housing 11 towards the side of the substrate 40, with respect to the fitting direction to the counterpart connector 80. In this case, since the route along the member of the first terminal 21 from the soldering portion 23*a* of the solder tail portion 23 through the contact portion 24*b* has a long distance and is bent in a complex manner, a phenomena of solder wicking does not occur. In other words, wicking of solder along the route of the member does not occur, and solder is not stuck to the contact portion 24*b*.

Moreover, a solder barrier portion (not shown) may be formed in the middle of the route along the member from the solder tail portion 23 through the contact portion 24*b* if necessary. The solder barrier portion is, for example, a nickel (Ni) film formed by plating, but if solder is not stuck to the film well, any kind of film can be used, and any kind of method may be used to form the film. Note that, it is preferred to form a gold (Au) film by plating the soldering portion 23*a* of the solder tail portion 23 in order to improve soldering adherence. Further, in order to reduce electrical contact resistance, it is preferred that a gold film be similarly formed by plating at least the contact portion 24*b*.

Here, a tapered portion 17 is included as a cut-out portion formed in the lower end of an outer portion of the housing 11, in other words, in the mounting-surface side end of the outer side surface of the side wall portion 14, and a tapered surface 17*a* is formed as a slope surface. Note that the tapered portion 17 and the tapered surface 17*a* extend in the array direction of the terminals, in other words, in the transverse direction in FIG. 2. In the illustrated example, the tapered surface 17*a* is formed so as to have a slope angle of approximately 45 degrees with respect to the mounting surface, but the slope angle can be set as appropriate.

In the illustrated example, the solder tail portion 23 extends along the outer side surface of the side wall portion 14, an approximately upper half region of the solder tail portion 23 is accommodated in the terminal accommodating cavity 15 formed in the outer side surface of the side wall portion 14, and an approximately lower half region of the solder tail portion 23 is located in the tapered portion 17 and is exposed beneath the tapered surface 17*a*.

Further, the top end of the press-fit portion 22 is connected to a portion of the horizontal portion 25 of the first terminal 21 between the top end of the back side wall portion 24*c* of the connecting portion 24 and the top end of the solder tail portion 23. The press-fit portion 22 extends in the fitting direction to the counterpart connector 80, and a raised portion 22*a* and a recessed portion 22*b* are formed on the side surface of the lower end portion of the press-fit portion 22, in other words, an end thereof in the vicinity of the mounting-surface side.

Meanwhile, a terminal fixing or securing hole 16 is formed in the side wall portion 14 of the housing 11, as a through hole extending in the fitting direction to the counterpart connector 80. When the first terminal 21 is moved in the fitting direction from the top surface side of the housing 11, in other words, from the top to the bottom in FIG. 3, and inserted into the terminal accommodating cavity 15 in order to mount the first terminal 21 onto the housing 11, the press-fit portion 22 is press-fitted into the terminal fixing hole 16 from the top in FIG. 3. In this case, the recessed portion 22*b* of the press-fit portion 22 is engaged with a raised portion 16*a* projecting from the side surface of the terminal fixing hole 16. Further, the lower end portion of the press-fit portion 22 projects beneath the terminal fixing hole 16, and the raised portion 22*a* is engaged with a lower side engaging surface 14*c* of the side wall portion 14, which is in parallel with the mounting surface. Therefore, the press-fit portion 22 cannot be pulled out from the terminal fixing hole 16 by moving the press-fit portion 22 upward, and the first terminal 21 is fixed to the housing 11. Note that the lower side engaging surface 14*c* is connected to the lower end of the tapered surface 17*a*, forming a shoulder portion. Furthermore, the lower end portion of the press-fit portion 22 is located above the bottom surface of the housing 11 so as not to come into contact with the mounting surface of the substrate 40.

As described above, since the first terminal 21 is fixed to the housing 11 by press-fitting the press-fit portion 22 into the terminal fixing hole 16, the outer side portion 14*a* of the side wall portion 14 located on the outer side of the terminal fixing hole 16, and the inner side portion 14*b* of the side wall portion 14 located on the inner side of the terminal fixing hole 16 need to have sufficient strength, and are therefore formed with a large thickness. The tapered portion 17 is formed in the lower end portion of the outer side portion 14*a* formed to have a large thickness. Further, the inner side portion 14*b* extends lower than the lower side engaging surface 14*c*, and is connected to the bottom plate portion 18.

As shown in FIG. 4, each of the second terminals 31 is a conductive member which is provided with a press-fit portion 32 as a fixing portion, and a connecting portion 34 to be mated to the counterpart terminal of the counterpart connector 80, and is preferably formed as a one piece member by stamping a conductive metal plate. Here, the connecting portion 34 is formed into an approximately U-letter shape, the other portion is formed into an approximately L-letter shape, and the second terminal 31, as a whole, has a side shape as though the letters U and L are connected.

Similar to the connecting portion 24 of the first terminal 21, the connecting portion 34 includes a front side wall portion 34*a* as a side wall portion closer to an end 36, and a back side wall portion 34*c* as a side wall portion closer to a solder tail portion 33, both extending in the mating direction to the counterpart connector 80, in other words, in a direction perpendicular to the mounting-surface (the vertical direction in FIG. 4). The front side wall portion 34*a* is a portion in the connecting portion 34, located on the inner side of the housing 11, and is accommodated in the terminal accommodating cavity 15 formed in the side surface of the linearly extending projection 13. The back side wall portion 34*c* is a portion in the connecting portion 34, located on the outer side of the housing 11, and is accommodated in the terminal accommodating cavity 15 formed on the side surface on the inner side of the side wall portion 14.

In addition, a portion of the connecting portion 34 which connects the front side wall portion 34*a* and the back side wall portion 34*c*, in other words, a bottom portion 34*d* which corresponds to the bottom of the U-letter, extends in a direction in parallel with the mounting-surface (the transverse direction in FIG. 4) similarly to the connecting portion 24 of the first terminal 21, and is accommodated within the terminal accommodating cavity 15 formed in the bottom surface of the recessed groove portion 12. Since the bottom plate portion 18 is positioned between the connecting portion 34 and the mounting-surface of the substrate 40, the connecting portion 34 does not come into contact with the mounting surface of the substrate 40. Therefore, conductive trace can be also provided on the mounting surface of the substrate 40 underneath the surface mount connector 10, allowing higher density of a conductive trace array on the substrate 40.

Moreover, a contact portion 34*b* to mate with the counterpart terminal of the counterpart connector 80 is formed in the vicinity of a free end (the top end in FIG. 4) of the front side wall portion 34*a*. Further, the contact portion 34*b* is formed so as to project from the surface of the front side wall portion 34*a* closer to the outer side of the housing 11, in other words, the surface facing inside the recessed groove portion 12, and is located within the recessed groove portion 12 so that at least the end 36 thereof projects outside the terminal accommodating cavity 15 formed in the side surface of the linearly extending projection 13. Note that the most part of the back side wall portion 34*c* is located within the terminal accommodating cavity 15 formed in the inner side wall of the side wall portion 14.

Similar to the connecting portion 24 of the first terminal 21, the connecting portion 34 has a spring property generated by the elastic deformation. Therefore, when the counterpart connector 80 is fitted to the surface mount connector 10, and the contact portion 34*b* is pressed towards the linearly extending projection 13 by being in contact with the counterpart terminal, the contact portion 34*b* repels due to the spring property, and is pressed against the counterpart terminal, ensuring that electrical connection between the second terminal 31 and the counterpart terminal is maintained.

The solder tail portion 33 of the second terminal 31 is connected to the lower end portion of the press-fit portion 32. Hence, a horizontal portion 35 of the second terminal 31, in other words, a portion which connects the top end of the back side wall portion 34*c* of the connecting portion 34 and the top end of the press-fit portion 32, extends in the direction in parallel with the mounting surface like the first terminal 21, and is accommodated in the terminal accommodating cavity 15 formed in the top surface of the side wall portion 14. In the case of the second terminal 31, since the solder tail portion 33 is connected via the press-fit portion 32, the portion on the outer side from the connecting portion 34 of the second terminal 31 does not form the F-letter shape, but has an approximately T-letter shape formed by the horizontal portion 35 and the press-fit portion 32.

The press-fit portion 32 extends in the fitting direction to the counterpart connector 80, and a raised portion 32*a* and a recessed portion 32*b* are formed on the side surface of the lower end portion thereof, in other words, an end in the vicinity of the mounting-surface side. Meanwhile, in the side wall portion 14 of the housing 11, a terminal fixing hole 16 is formed as a through hole extending in the fitting direction to the counterpart connector 80. When the second terminal 31 is moved from the top surface side of the housing 11 in the mating direction, in other words, from the top to the bottom in FIG. 4, and is inserted into the terminal accommodating cavity 15 in order to mount the second terminal 31 on the housing 11, the press-fit portion 32 is press-fitted into the terminal fixing hole 16 from the top in FIG. 4.

In this case, similar to the first terminal 21, the recessed portion 32*b* of the press-fit portion 32 is engaged with the raised portion 16*a* projecting from the side surface of the terminal fixing hole 16. Moreover, the lower end portion of the press-fit portion 32 projects underneath the terminal fixing hole 16, and the raised portion 32*a* is engaged with the lower side engaging surface 14*c* of the side wall portion 14, which is in parallel with the mounting surface. Hence, the press-fit portion 32 cannot be pulled out from the terminal fixing hole 16 by moving the press-fit portion 32 upward, and the second terminal 31 is fixed to the housing 11.

As described above, since the second terminal 31 is fixed to the housing 11 by press-fitting the press-fit portion 32 into the terminal fixing hole 16, the outer side portion 14*a* of the side wall portion 14 located on the outer side of the terminal fixing hole 16, and the inner side portion 14*b* of the side wall portion 14 located on the inner side of the terminal fixing hole 16 need to have sufficient strength and are thus formed to have a large thickness. The tapered portion 17 is formed in the lower end portion of the outer side portion 14*a* which is formed to have a large thickness. Further, the inner side portion 14*b* extends lower than the lower side engaging surface 14*c*, and is connected to the bottom plate portion 18. Furthermore, it is preferred that, in order to stabilize the attitude of the second terminal 31, the horizontal portion 35 of the second terminal 31 extends towards the outer side of the housing 11 than the press-fit portion 32, and is in contact with the entire top surface of the outer side portion 14*a* in which the terminal accommodating cavity 15 is formed as shown in FIG. 4.

Yet further, the solder tail portion 33 is connected to the lower end portion of the press-fit portion 32, as a soldering portion which extends in the fitting direction to the counterpart connector 80. In other words, the solder tail portion 33 extends towards the mounting-surface side from the terminal fixing hole 16. The lower end portion of the solder tail portion 33, in other words, the end portion on the mounting-surface side serves as a soldering portion 33*a* to be connected by soldering to a connecting pad 42 formed on the mounting surface of the substrate 40. The location of the soldering portion 33*a* is the same as the bottom surface of the housing 11 or is further projected towards the side of the substrate 40, with respect to the fitting direction to the counterpart connector 80. In this case, similarly to the first terminal 21, the route along the member of the second terminal 31 from the soldering portion 33*a* of the solder tail portion 33 through the contact portion 34*b* has a long distance and is bent in a complex manner, a phenomena of solder wicking does not occur. In other words, wicking of solder along the route of the members does not occur, and solder is not stuck to the contact portion 34*b*.

Moreover, a not-illustrated solder barrier portion may be formed in the middle of the route along the members from the solder tail portion 33 through the contact portion 34*b*, if necessary. Further, it is preferred to form a gold film by plating in the soldering portion 33*a* of the solder tail portion 33 in order to improve soldering adherence. Further, in order to reduce electrical contact resistance, it is preferred that a gold film be similarly formed at least in the contact portion 34*b* by plating.

In the second terminal 31, since the solder tail portion 33 is connected to the lower end portion of the press-fit portion 32, the soldering portion 33*a* is located on the inner side of the housing 11 of the soldering portion 23*a* of the first terminal 21. As described earlier, the first terminals 21 and the second terminals 31 are accommodated alternately within the terminal accommodating cavities 15. Hence, the soldering portions 23*a*, the soldering portions 33*a*, and the connecting pads 41 and 42 formed on the mounting surface of the substrate 40 to correspond to the soldering portions 23*a* and 33*a*, respectively, are positioned in a zigzag or staggering shape when viewed from the top of the surface mount connector 10, where they are shifted alternately in the transverse direction relative to the array direction of the terminals, in other words, in the left-and-right direction in FIG. 1. Therefore, even if the pitch between the first terminal 21 and the second terminal 31 is narrow, a distance between the soldering portion 23*a* of the first terminal 21, and the soldering portion 33*a* of the second terminal 31, and a distance between the connecting pad 41 formed on the mounting surface of the substrate 40 to correspond to the soldering portion 23*a*, and the connecting pad 42 formed on the mounting surface of the substrate 40 to correspond to the soldering portion 33*a* can be increased. Accordingly, the connecting pads 41 and 42 can be fabricated easily, and, when the soldering portions 23*a* of the first terminals 21 and the soldering portions 33*a* of the second terminals 31 are soldered to the corresponding connecting pads 41 and 42, a solder bridge does not occur, and short circuit does not happen between the neighboring connecting pads 41 and 42.

Also, although the soldering portion 33*a* of the second terminal 31 is located on the inner side of the housing 11, the tapered portion 17 is formed underneath the outer side portion 14*a* as shown in FIG. 4. Therefore, even in a state where the surface mount connector 10 is mounted on the mounting surface of the substrate 40, the state of the soldering portion 33*a* being soldered to the corresponding connecting pad 42 can be visually inspected easily from the side of the surface mount connector 10, and a solder fillet formed in a connecting portion between the soldering portion 33*a* and the connecting pad 42 can be checked visually. In the illustrated example in particular, the soldering portion 33*a* is located on the side of the mounting surface of the substrate 40 on a surface extending from the tapered surface 17*a* towards the mounting surface of the substrate 40. This means that the solder tail portion 33 projects lower than a surface extending downward from the tapered surface 17*a*. Therefore, the state of the soldering portion 33*a* can be viewed easily from the side of the surface mount connector 10.

Note that, since the solder tail portion 23 of the first terminal 21 extends along the side surface of the housing 11, the state of the soldering portion 23*a* located in the lower end portion thereof can be easily viewed from the side of the surface mount connector 10.

As described above, in this embodiment, each of the first terminals 21 includes the connecting portion 24 to be connected to the counterpart terminal, the press-fit portion 22 connected to the outer side of the connecting portion 24 and fixed to the housing 11, and the surface-mounting solder tail portion 23 connected to the outer side of the press-fit portion 22, each of the second terminals 31 includes the connecting portion 34 to be connected to the counterpart terminal, the press-fit portion 32 connected to the outer side of the connecting portion 34 and fixed to the housing 11, and the surface-mounting solder tail portion 33 connected to the mounting-surface side end of the press-fit portion 32, and the housing 11 is provided with the tapered portion 17 including the tapered surface 17*a* formed in the mounting-surface side end of the outer portion.

Hence, the soldering portions 23*a* and the soldering portions 33*a* can be arranged in a zigzag shape, and, the soldering states of the soldering portions 33*a* of the second terminals 31 can be easily viewed from the side of the surface mount connector 10. Therefore, as the soldering states of the soldering portions 33*a* and the connecting pads 42 of the substrate 40 can be visually inspected, mounting of the surface mount connector 10 onto the substrate 40 can be ensured. Also, because connection defects are less likely to occur, reliability can be increased, and manufacturing costs can be reduced.

Further, the housing 11 is provided with the bottom plate portion 18 which extends in the direction perpendicular to the fitting direction on the mounting-surface side of the connecting portion 24 and the bottom portion 34*d* of the connecting portion 34. Therefore, the connecting portion 24 and the connecting portion 34 are prevented from being in contact with the mounting surface of the substrate 40, and conductive trace is thus able to be provided on the area of the mounting surface of the substrate 40 beneath the surface mount connector 10, realizing a higher density of a conductive trace array on the substrate 40.

Furthermore, the solder tail portion 33 of the second terminal 31 projects to the mounting-surface side of the surface extending from the tapered surface 17*a* towards the mounting surface. Therefore, the state of the soldering portion 33*a* can be easily viewed from the side of the surface mount connector 10.

Next, a second embodiment of the present invention is described. Note that portions having the same constructions as those in the first embodiment are represented by the same reference numerals, and the descriptions thereof are thus omitted. Also, the descriptions of the same operations and effects as those in the first embodiment will be omitted.

Figure 5:
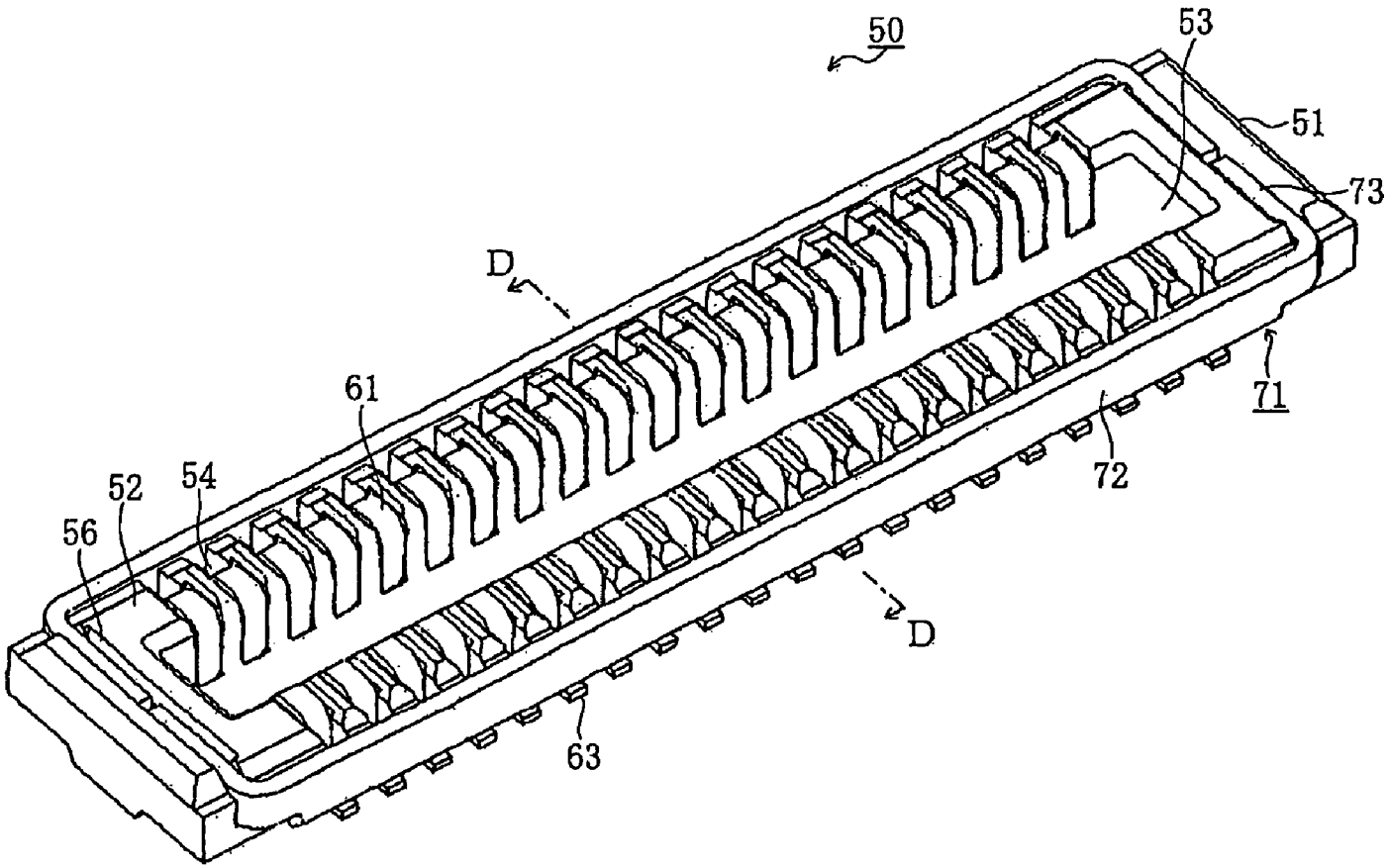
FIG. 5 is a perspective view of a surface mount connector according to a second embodiment of the present invention.
Figure 6:
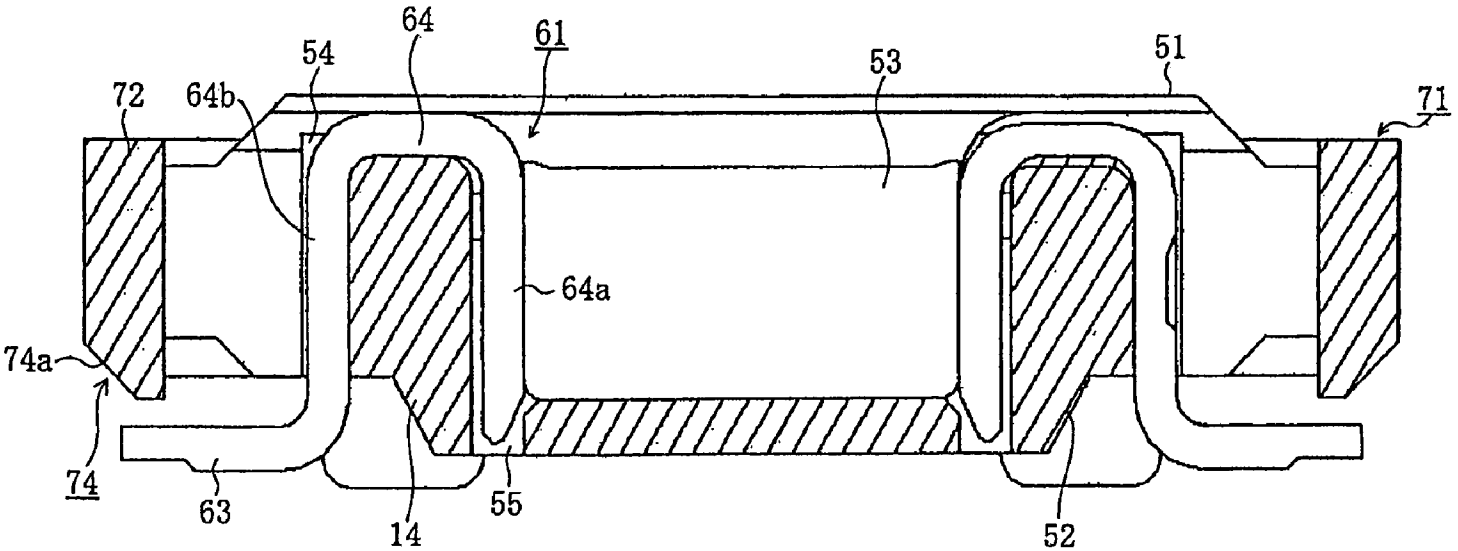
FIG. 6 is a cross sectional view of the surface mount connector according to the second embodiment of the present invention, taken along the arrow D-D in FIG. 5.
Figure 7:
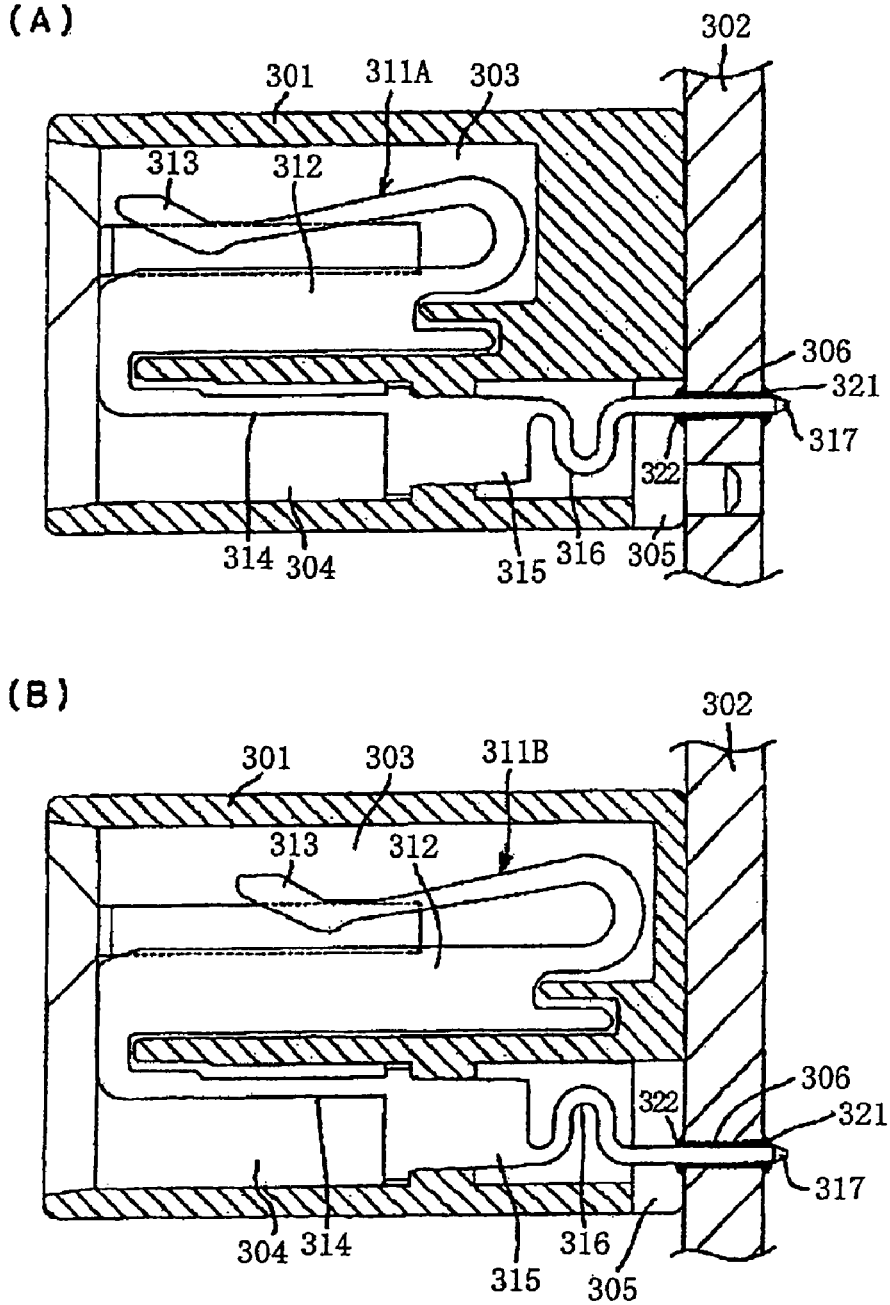
(Prior art) FIG. 7

FIG. 5 is a perspective view of a surface mount connector according to a second embodiment of the present invention, and FIG. 6 is a cross sectional view of the surface mount connector according to the second embodiment of the present invention, taken along the arrow D-D in FIG. 5.

In these drawings, reference numeral 50 represents a surface mount connector according to this embodiment, and is a surface-mount type connector to be mounted on a surface of a not-illustrated substrate, such as a printed circuit board. In this case, the lower side surface in FIG. 6 is a mounting surface for the surface mount connector 50, and faces the mounting surface of the substrate. The surface mount connector 50 can function as the counterpart connector of the surface mount connector 10 described in the first embodiment. In this case, the surface mount connector 10 of the first embodiment moves from the top to the bottom in FIG. 6, and is fitted to the surface mount connector 50. Note that the surface mount connector 50 does not necessarily serve as the counterpart connector of the surface mount connector 10 in the first embodiment.

In this embodiment, representations of directions such as up, down, left, right, front, rear, and the like, used for explaining the structure and movement of each part of the surface mount connector 50, and the like, are not absolute, but relative. These representations are appropriate when each part of the surface mount connector 50, and the like, is in the position shown in the figures. If the position of the surface mount connector 50, and the like, changes, however, it is assumed that these representations are to be changed according to the change of the position of the surface mount connector 50, and the like.

The surface mount connector 50 includes a housing 51 as a connector body integrally formed from an insulating material such as a synthetic resin. As shown in FIG. 5, the housing 51 has an approximately rectangular thick plate shape, and linearly extending projections 52 extending in the longitudinal direction are formed integrally with the housing 51 on the top surface. Note that the linearly extending projections 52 are formed along with both sides of the housing 51, respectively. Moreover, a thin and long recessed groove portion 53 extending in the longitudinal direction of the housing 51 is formed between the linearly extending projections 52 on both sides.

Terminal accommodating cavities 54 in a recessed groove shape for accommodating terminals 61 are formed from the side wall through the top surface of the linearly extending projections 52 on both sides. For example, twenty terminal accommodating cavities 54 are formed at a pitch of approximately 0.3 [mm] on the side wall and top surface of each of the linearly extending projections 52 on both sides. Accordingly, twenty terminals 61 to be accommodated in the terminal accommodating cavities 54, respectively, are arranged at a pitch of approximately 0.3 [mm] on the side wall and top surface of each of the linearly extending projections 52 on both sides. Further, in portions of the recessed groove portion 53 in the boundary area with the linearly extending projections 52, terminal end accommodating holes 55 are formed in locations which correspond to the terminal accommodating cavities 54, respectively. The pitch and number of the terminal end accommodating holes 55 are the same as those for the terminal accommodating cavities 54. Note that the pitch and number of the terminal accommodating cavities 54, the terminal end accommodating holes 55, and the terminals 61 can be changed as appropriate.

Further, when the surface mount connector 50 works as the counterpart connector of the surface mount connector 10 in the first embodiment, the terminals 61 work as the counterpart terminals for the first terminals 21 and the second terminals 31 of the surface mount connector 10 in the first embodiment. In this case, the pitch and number of the terminal accommodating cavities 54, the terminal end accommodating holes 55, and the terminals 61 are set so as to correspond to the surface mount connector 10 in the first embodiment.

Next, the construction of the terminals 61 is described.

As shown in FIG. 6, each of the terminals 61 is a conductive member which is provided with a solder tail portion 63 for surface mounting, and a connecting, portion 64, which are preferably formed integrally by stamping a conductive metal plate. Here, the terminal 61 has a dipper-like shape in a side view, in which the connecting portion 64 is formed into an approximately U-letter shape, and the solder tail portion 63 is formed into a linear shape.

The connecting portion 64 includes a front side wall portion 64*a* as a side wall portion closer to an end thereof, which extends the vertical direction and is to be accommodated in the terminal accommodating cavity 54 formed in the inner side wall of the linearly extending projection 52, and a back side wall portion 64*b* as a side wall portion closer to the solder tail portion 63, which extends in the vertical direction, and is accommodated in the terminal accommodating cavity 54 formed on the outer side wall of the linearly extending projection 52. Note that a bottom portion between the front side wall portion 64*a* and the back side wall portion 64*b*, in other words, a portion corresponding to the bottom of the U-letter, extends in the transverse direction, and is accommodated in the terminal accommodating cavity 54 formed on the top surface of the linearly extending projection 52. Further, the end portion of the front side wall portion 64*a* is accommodated in the terminal end accommodating hole 55. The terminal 61 is fixed to the housing 51 as the connecting portion 64 is pressed into the terminal accommodating cavity 54.

Furthermore, an inner side end, in other words, an end on the side of the recessed groove portion 53 of the solder tail portion 63 is connected to the back side wall portion 64 and extends in the transverse direction. The bottom surface of the solder tail portion 63 is soldered to a connecting pad or the like formed on a mounting surface of a non-illustrated substrate. Note that, when the surface mount connector 50 functions as the counterpart connector of the surface mount connector 10 in the first embodiment, the front side wall portions 64*a* function as contact portions for the counterpart terminals, which are to be in contact with the contact portions 24*b* of the first terminals 21 and the contact portions 34*b* of the second terminals 31. Moreover, a not-illustrated solder barrier portion may be formed as necessary in the middle of a route along the members from the solder tail portion 63 through the front side wall portion 64*a*. The solder barrier portion is, for example, a nickel (Ni) film formed by plating, but may be any kind of film as long as solder is not easily adhered, and any kind of method may be used to form the film. The solder barrier portion prevents a phenomena of solder wicking, in which wicking of solder occurs along the members of the terminal 61 and solder is stuck to the surface of the front side wall portion 64*a* when soldering the solder tail portion 63 to the connecting pad or the like on the substrate.

Note that, it is preferred that a gold (Au) film is formed by plating in a soldering portion of the solder tail portion 63 in the soldering portion of the solder tail portion 63 in order to improve soldering adherence. Further, in order to reduce electrical contact resistance, it is preferred that a gold film be similarly formed by plating at least on the surface of the front side wall portion 64*a*.

Incidentally, shield members 71 formed from conductive members are attached to the housing 51. The shield members 71 are accommodated within holding grooves 56 formed in the vicinities of both ends in the longitudinal direction of the housing 51, held by the housing 51, surrounding the side surfaces of the housing 51, and are arranged to surround the entire surface mount connector 50. To be more specific, the shield members 71 are a pair of members, and each has an approximately U-letter shape, including a thin and long strip-shaped body portion 72 extending in the longitudinal direction of the housing 51, and held portions 73 connected to both ends of the body portion 72. Note that the pair of shield members 71 may be integrated into one piece having an approximately O-letter shape.

The shield members 71 surround the circumference of at least the area in which the terminals 61 are arranged, and the body portions 72 face the side walls on the outer side of the linearly extending projections 52, and extend so as to be in parallel with the side walls. Further, in the illustrated example, the dimension of the shield members 71 relative to the fitting direction of the surface mount connector 50, in other words, the vertical direction in FIG. 6, is set to approximately correspond to the dimension of the back side wall portions 64*b* of the terminals 61. Hence, most parts of the outer side surfaces of the back side wall portions 64*b* face the shield members 71, ensuring that the terminals 61 are prevented from having electromagnetic influences from outside the surface mount connector 50.

Because the shield members 71 are members for shielding electromagnetic emissions, it is preferred that gaps between the mounting surface of the substrate on which the surface mount connector 50 is mounted and the shield members 71, and gaps between the mounting surface of the substrate on which a counterpart connector to be fitted to the surface mount connector 50 is mounted and the shield members 71 are minimized. Nevertheless, if the gaps between the mounting surface of the substrate on which the surface mount connector 50 is mounted and the shield members 71 are reduced, it becomes difficult to view from the side of the surface mount connector 50 a state where the lower side surface of the solder tail portion 63 is soldered to the corresponding connecting pad or the like.

Therefore, in this embodiment, in a lower end on the outer side of each of the shielding members 71, a tapered portion 74 is included as a cut-out portion formed by cutting out the member, and a tapered surface 74*a* is formed as a slope surface. Note that the tapered portion 74 and the tapered surface 74*a* extend in the array direction of the terminals 61, in other words, in the longitudinal direction of the body portion 72. In the illustrated example, the tapered surface 74*a* is formed to have a slope angle of approximately 45 degrees relative to the mounting surface, but the slope angle may be set as appropriate.

As described so far, in this embodiment, the surface mount connector 50 includes the terminals 61 and the shield members 71 attached to the housing 51, each of the terminals 61 is provided with the solder tail portion 63 for surface mounting, extending outward of the side surface of the housing 51, the shield members 71 surround the side surface of the housing 51 and are provided with the tapered portions 74 which includes the tapered surfaces 74*a* formed in the end on the mounting-surface side on the outer side.

Hence, a soldering state of the soldering portion of the terminal 61 can be viewed easily from the side of the surface mount connector 50. Thus, the soldering state between the soldering portion and the connecting pad or the like on the substrate can be visibly inspected, ensuring that the surface mount connector 50 is mounted on the substrate. Further, since no connection defect occurs, the reliability is improved, and manufacturing costs can be reduced.

The present invention is not limited to the above-described embodiments, and may be changed in various ways based on the gist of the present invention, and these changes are not eliminated from the scope of the present invention.

What is claimed is:

1. A surface mount connector, the surface mount connector comprising:

first terminals and second terminals mated to first counterpart terminals and second counterpart terminals, respectively, of a mating counterpart connector; and an insulative housing on which the first and the second terminals are mounted in an alternating, array;

wherein:

each first terminal includes a contact portion to be connected to the first counterpart terminal, a fixing portion connected to an outer side of the contact portion and fixed to the housing, and a surface-mounting soldering portion connected to an outer side of the fixing portion; and each second terminal includes a contact portion to be connected to the second counterpart terminal, a fixing portion connected to an outer side of the connecting portion and fixed to the housing, and a surface-mounting soldering portion connected to a mounting-surface side end of the fixing portion.

2. The surface mount connector of claim 1, wherein the housing includes a cut-out portion, the cut-out portion including a tapered surface formed in a mounting-surface side end of an outer portion thereof.

3. The surface mount connector of claim 1, wherein the second terminal fixing portion and the second terminal surface-mounting soldering portion are collinear.

4. The surface mount connector of claim 3, wherein the housing includes a cut-out portion, the cut-out portion including a tapered surface formed in a mounting-surface side end of an outer portion thereof.

5. The surface mount connector of claim 1, wherein each contact portion includes a front side wall portion and a back side wall portion extending in a fitting direction to the counterpart connector, and a bottom portion extending in a direction perpendicular to the fitting direction and connecting the front side wall portion and the back side wall portion.

6. The surface mount connector of claim 1, wherein the housing includes a side wall portion in which terminal fixing holes are provided into which the fixing portions are press-fitted.

7. The surface mount connector of claim 5, the housing further includes a bottom plate portion extending in a direction perpendicular to the fitting direction on the mounting-surface side of the bottom portion.

8. The surface mount connector of claim 6, wherein the fixing portions are press-fit into the terminal fixing holes by being moved to the side wall portion from a side on which the counterpart connector is fitted towards the mounting surface.

9. The surface mount connector of claim 8, wherein the soldering portion of each first terminal extends along a side surface of the outer portion of the side wall portion.

10. The surface mount connector of claim 8, wherein the tapered surface is formed in the mounting-surface side end of a portion of the side wall portion which is located on an outer side of the terminal fixing hole.

11. The surface mount connector of claim 10, wherein the soldering portion of each second terminal extends to the mounting-surface side of a surface extending from the tapered surface toward the mounting surface.

12. The surface mount connector of claim 9, wherein the soldering portion of each second terminal extends from the terminal fixing hole toward the mounting surface.

* * * * *